US008109654B2

(12) United States Patent
Mo

(10) Patent No.: US 8,109,654 B2
(45) Date of Patent: Feb. 7, 2012

(54) LED LAMP

(75) Inventor: Ci-Jin Mo, Shenzhen (CN)

(73) Assignees: Fu Zhun Precision Industry (Shen Zhen) Co., Ltd., Shenzhen, Guangdong (CN); Foxconn Technology Co., Ltd., Tu-Cheng, New Taipei (TW)

( * ) Notice: Subject to any disclaimer, the term of this patent is extended or adjusted under 35 U.S.C. 154(b) by 350 days.

(21) Appl. No.: 12/580,263

(22) Filed: Oct. 16, 2009

(65) Prior Publication Data

US 2011/0019402 A1 Jan. 27, 2011

(30) Foreign Application Priority Data

Jul. 21, 2009 (CN) ..... 2009 1 0304616

(51) Int. Cl.
*F21V 21/00* (2006.01)

(52) U.S. Cl. ..... 362/249.02; 362/249.01; 362/294; 362/373; 362/545; 362/547

(58) Field of Classification Search ..... 362/227, 362/234, 249.01–249.02, 294, 373, 382, 362/543–547, 800
See application file for complete search history.

(56) References Cited

U.S. PATENT DOCUMENTS

2006/0193130 A1* 8/2006 Ishibashi ..... 362/227
2009/0175041 A1* 7/2009 Yuen et al. ..... 362/294

* cited by examiner

*Primary Examiner* — Stephen F Husar
*Assistant Examiner* — Meghan Dunwiddie
(74) *Attorney, Agent, or Firm* — Altis Law Group, Inc.

(57) ABSTRACT

An LED lamp includes a heat sink including a supporting plate, a light-reflecting member mounted on a bottom face of the supporting plate, and a plurality of LEDs disposed on the bottom face of the supporting plate. The light-reflecting member defines a plurality of concave portions recessed inwardly from an outer face thereof. The LEDs include a plurality of first LEDs arranged within the light-reflecting member and a plurality of second LEDs arranged outside the light-reflecting member. The second LEDs are located corresponding to the concave portions, respectively, whereby light generated by the second LEDs can be reflected by the light-reflecting member to illuminate a large area.

15 Claims, 4 Drawing Sheets

LED LAMP

BACKGROUND

1. Technical Field

The disclosure relates to LED (light emitting diode) lamps for illumination purpose and, more particularly, relates to an improved LED lamp having a large illumination area.

2. Description of Related Art

An LED lamp is a type of solid-state lighting that utilizes LEDs as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Since LED lamps have many advantages, they often act as street, lawn or home lamps for illumination purpose. Known implementations of LED module in an LED lamp make use of a plurality of individual LEDs to generate light that is ample and of satisfactory spatial distribution. The large number of LEDs, however, increase price and power consumption of the module. Considerable heat is also generated, which, if not adequately addressed at additional expense, impacts LED lamp reliability.

Further, since the LEDs are generally arranged on a printed circuit board having a flattened face, light emitted from the LEDs is concentrated on a small area confronting the LEDs due to high directivity of the LEDs, which is unsuitable for environments requiring even and broad illumination. Thus, the LEDs mounted on the flattened face of the printed circuit board cannot have a large area of illumination.

What is needed, therefore, is an improved LED lamp which can overcome the above problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
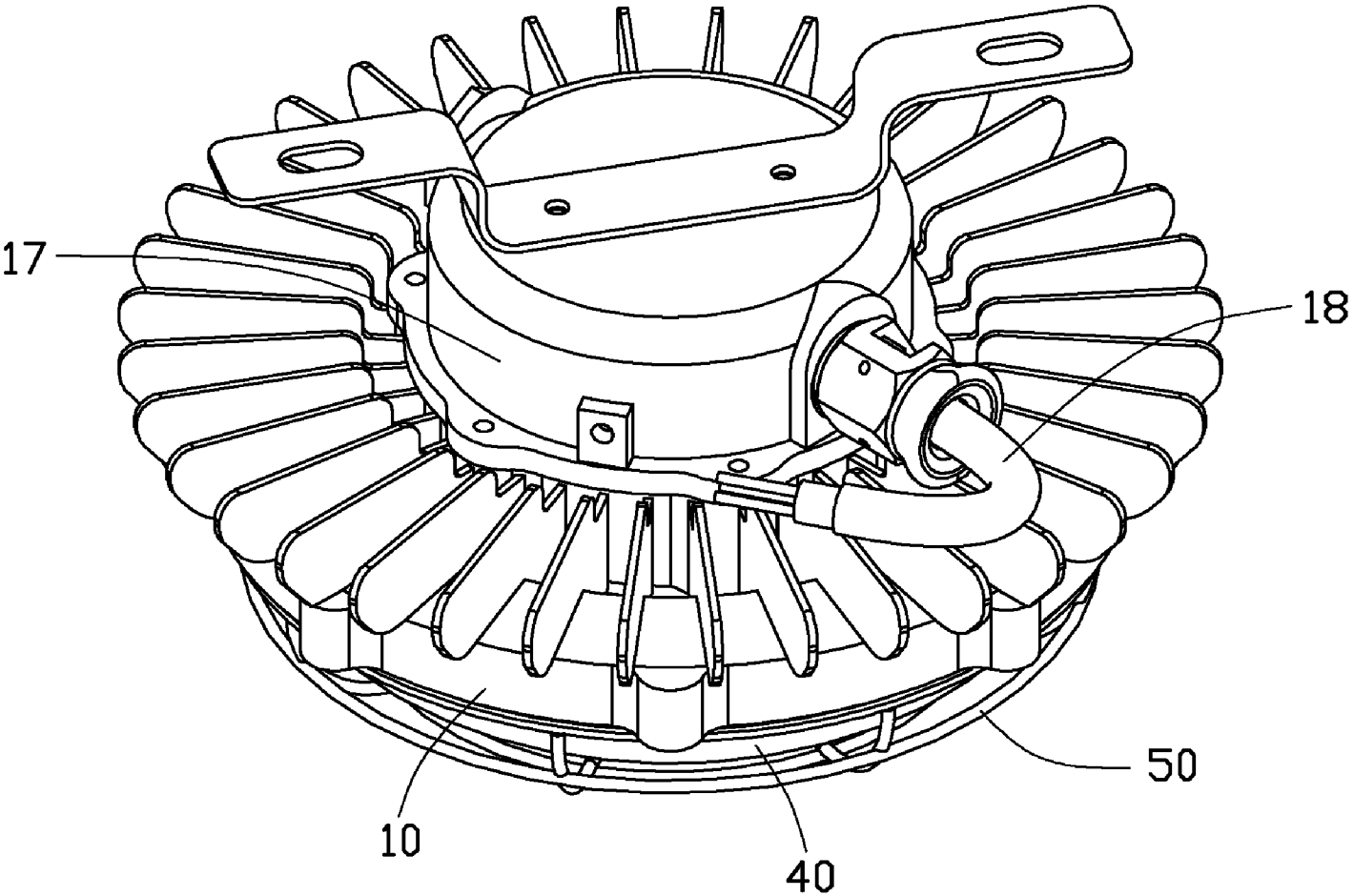
FIG. 1 is an isometric, assembled view of an LED lamp in accordance with an embodiment of the disclosure.
Figure 2:
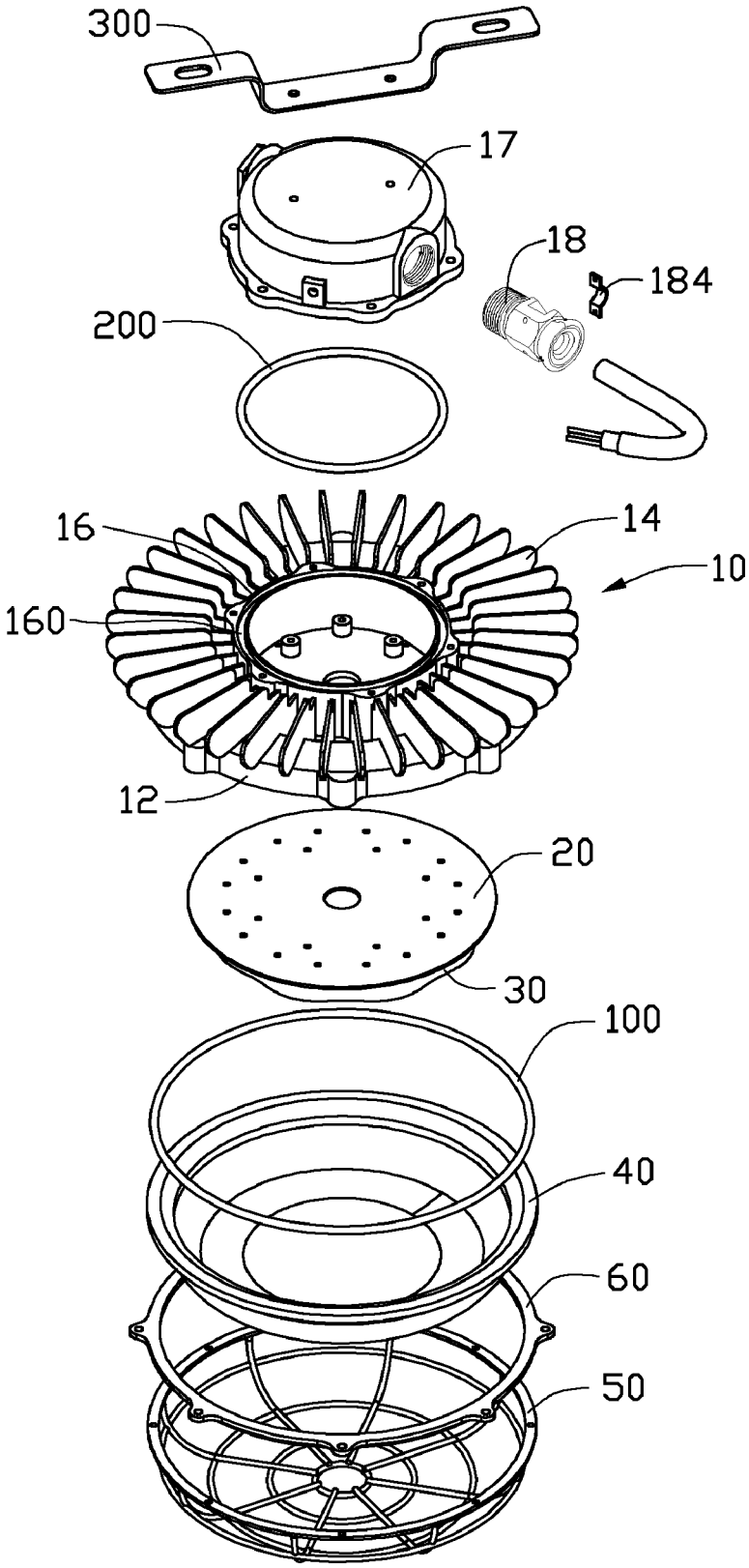
FIG. 2 is an exploded view of the LED lamp of FIG. 1.

Referring to FIGS. 1 and 2, a light emitting diode (LED) lamp in accordance with an embodiment of the disclosure is illustrated. The LED lamp comprises a heat sink 10, an LED module 20 thermally attached to a bottom face of the heat sink 10, a light-reflecting member 30 disposed on the bottom face of the heat sink 10, an envelope 40 mounted on the heat sink 10 and correspondingly covering the LED module 20, a pressing frame 60 securing the envelope 40 to the heat sink 10 and a protecting cage 50 encircling the envelope 40.

Figure 3:
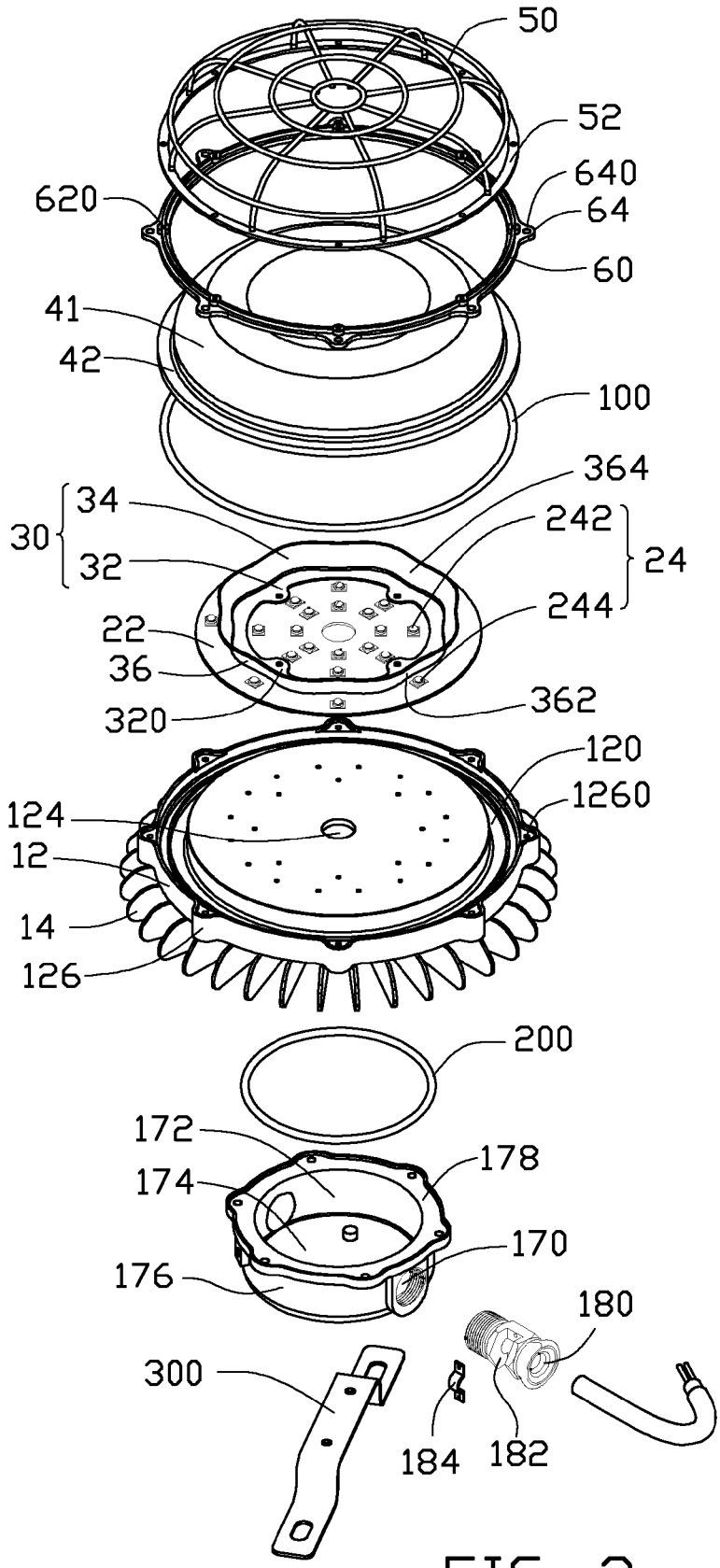
FIG. 3 is an inverted, exploded view of the LED lamp of FIG. 1.

Referring to FIG. 3 also, the heat sink 10 is integrally made of a metal with good heat conductivity such as aluminum, copper or an alloy thereof. The heat sink 10 comprises a circular supporting plate 12, a cylindrical connecting portion 16 extending perpendicularly and upwardly from a central portion of a top face of the supporting plate 12, and a plurality of fins 14 extending upwardly from the top face of the supporting plate 12 and arranged around the connecting portion 16. An annular receiving groove 120 is defined along an outer periphery of a bottom face of the supporting plate 12. An annular sealing gasket 100 is received in the receiving groove 120 for achieving a hermetical connection between the heat sink 10 and the envelope 40. A circular protrusion (not labeled) is formed at a central area of the supporting plate 12 and surrounded by the receiving groove 120. A through hole 124 is defined in a center of the protrusion of the supporting plate 12 for electrical wires (not shown) extending through the heat sink 10 and electrically connecting the LED module 20.

A plurality of protruding ribs 126 protrude outwardly and perpendicularly from an outer circumference of the supporting plate 12. The protruding ribs 126 are parallel to and equally spaced from each other. The protruding ribs 126 extend along a top-to-bottom direction of the supporting plate 12, and each has a semicircular cross-section along a horizontal direction. A screw hole 1260 is defined in a central portion of a bottom end of each protruding rib 126. The fins 14 extend radially relative to the connecting portion 16 on the supporting plate 12. A passage (not labeled) is defined between every two neighboring fins 14. An annular groove 160 is defined in a top face of the connecting portion 16. A sealing ring 200 is received in the annular groove 160 for achieving a hermetical connection between the heat sink 10 and a hollow mounting member 17.

The hollow mounting member 17 is correspondingly disposed on a top side of the connecting portion 16 of the heat sink 10 and cooperates with the connecting portion 16 to define a receiving chamber 172 for accommodating a driving module (not shown) therein. A safety connector 18 is further provided to the mounting member 17 for allowing the electrical wires to extend therethrough into the receiving chamber 172. The mounting member 17 is in a can shape and comprises a circular top wall 174 and a cylindrical sidewall 176 extending perpendicularly and downwardly from an outer periphery of the top wall 174 and an annular flange 178 extending horizontally and outwardly from a bottom end of the sidewall 176. The sidewall 176 has a diameter slightly smaller than that of the connecting portion 16 of the heat sink 10. The flange 178 of the mounting member 17 is fixed to the connecting portion 16, and the sealing ring 200 is compressed between the flange 178 and the connecting portion 16 for achieving a waterproof sealing performance of the LED lamp. A mounting hole 170 is defined in one side of the sidewall 176 of the mounting member 17 for threadedly engaging the safety connector 18 thereinto.

The safety connector 18 is tubular and defines a central hole 180 corresponding to the mounting hole 170 for extension of the electrical wires. A cutout 182 is defined in one side of the safety connector 18 for receiving a pressing piece 184 therein. The cutout 182 communicates with the central hole 180 for exposing a portion of the electrical wires received in the safety connector 18. The pressing piece 184 is arced, and defines two fixing holes (not labeled) at two opposite ends thereof. The pressing piece 184 is connected to the safety connector 18 via bolts (not shown) extending through the fixing holes thereof and screwing into the safety connector 18. The pressing piece 184 tightly secures the electric wires against an inner face of the safety connector 18, whereby the electrical wires are reliably held in the central hole 180 via the pressing piece 184.

Referring to FIG. 2 again, a fixing bracket 300 is disposed on the top wall 174 of the mounting member 17. The fixing bracket 300 is an elongated and bended sheet, and comprises a upright U-shaped fixing portion (not labeled) which is fixed on the top wall 174 and two arms (not labeled) extending outwardly and horizontally from two opposite sides of the fixing portion. In use, the LED lamp can be fixed to walls or ceilings via the fixing bracket 300.

The LED module 20 comprises a circular printed circuit board 22 and a plurality of LEDs 24 mounted on the printed circuit board 22. The printed circuit board 22 is thermally attached on the bottom face of the supporting plate 12 of the heat sink 10, and the LEDs 24 are arranged evenly on the printed circuit board 22. The LEDs 24 comprise a plurality of first LEDs 242 located at a central region of the printed circuit board 22, and a plurality of second LEDs 244 located near an edge region of the printed circuit board 22. That is to say, the second LEDs 244 surround the first LEDs 242. It is understood that the printed circuit board 22 is a base which can support the LEDs 24 and electrically connect the LEDs 24 to a power supply. The first LEDs 242 are used to illuminate a main working space facing the LEDs 24 on the printed circuit board 22, and the second LEDs 244 are used to additionally illuminate an area outside of the main working space. The LEDs 24 are arranged in a number of imaginary concentric circles.

The light-reflecting member 30 is located between the second LEDs 244 and the first LEDs 242. The light-reflecting member 30 is concentric to the imaginary concentric circles defined by the LEDs 24. The light-reflecting member 30 comprises a planar and annular seat 32 and a cylindrical reflecting portion 34 extending downwardly and outwardly from an outer circumference of the seat 32. A diameter of the reflecting portion 34 increases gradually along a direction downwardly away from the seat 32. An inner surface of the reflecting portion 34 faces the first LEDs 242 and an outer surface of the reflecting portion 34 faces the second LEDs 244. The inner surface of the reflecting portion 34 is configured to guide the light generated by the first LEDs 242, and the outer surface of the reflecting portion 34 is configured to guide the light generated by the second LEDs 244. A plurality of concave portions 36 are recessed inwardly from the outer surface of the reflecting portion 34, whereby the reflecting portion 34 has a waved shape. The concave portions 36 are spaced from each other, and each of the concave portions 36 is located corresponding to one second LED 244. The seat 32 defines a plurality of thread holes (not labeled), for a plurality of screws (not shown) extending therethrough and threadedly engaging into the printed circuit board 22 to thereby secure the light-reflecting member 30 on the printed circuit board 22.

The concave portions 36 of the light-reflecting member 30 each has a concave outer reflecting surface 362 facing the second LED 244 and a convex inner reflecting surface 364 facing the first LED 242. The outer reflecting surface 362 of each concave portion 36 correspondingly faces one second LED 244 and partially surrounds the second LED 244. The outer reflecting surface 362 and the inner reflecting surface 364 each can be a paraboloid surface, a spherical surface, an aspheric surface or an ellipsoid surface, and functions to reflect and adjust the distribution of luminous intensity of the light generated by the first LEDs 242 and the second LEDs 244, respectively. In detail, the outer reflecting surfaces 362 are for converging a part of the light emitted from the second LEDs 244 into light beams which leave the LED lamp with large light-emergent angles, to thereby illuminate an area away from the main working space; the inner reflecting surfaces 364 are for diverging a part of the light emitting from outmost first LEDs 242 towards the main working space, to illuminate the main working space with an even intensity.

The light-reflecting member 30 can be made of plastic or metallic material. According to practical requirement, the inner and outer surface of the reflecting portion 34, especially the outer and inner surfaces 362, 364 of the concave portions 36, can be particularly treated to optimize light reflection of the light-reflecting member 30. For example, the surfaces can be treated to be diffused, reflective surfaces by spraying or coating white reflecting material thereon, or highly reflective surfaces by plating a metallic coating thereon.

The envelope 40 is integrally formed of a transparent or half-transparent material such as glass, resin or plastic. The envelope 40 comprises a bowl-shaped main body 41 defining an opening (not labeled) at a top end thereof and an engaging flange 42 extending outwardly and horizontally from a periphery of the top end of the main body 41. The engaging flange 42 has a size corresponding to the receiving groove 120 of the supporting plate 12. When the envelope 40 is connected to the heat sink 10, the engaging flange 42 is fitly accommodated in the receiving groove 120, and the sealing gasket 100 is sandwiched between the engaging flange 42 and the supporting plate 12 for achieving a waterproof sealing performance of the LED lamp.

The pressing frame 60 is annular and has a plurality of spaced protruding tabs 64 extending radially and outwardly from an outer periphery thereof. The pressing frame 60 has a diameter substantially equal to that of the engaging flange 42 of the envelope 40. The protruding tabs 64 are evenly distributed along a circumference of the pressing frame 60. Each of the protruding tabs 64 is substantially semicircular shaped, and defines a securing hole 640 at a center thereof. The securing holes 640 of the protruding tabs 64 are aligned with the screw holes 1260 of the protruding ribs 126, respectively. Fasteners (not shown) are brought to extend through the securing holes 640 and the screw holes 1260 to secure the heat sink 10 with the pressing frame 60. A plurality of spaced protruding blocks (not labeled) protrude inwardly from an inner periphery of the pressing frame 60. Each of the protruding blocks defines a blind securing hole 620 therein.

The protecting cage 50 has a shape corresponding to that of the envelope 40, and has a size slightly larger than the envelope 40. The protecting cage 50 comprises a plurality of wires (not labeled) interlaced with each other. The protecting cage 50 is configured as a bowl-shaped mesh having a plurality of openings between the wires. A pressing flange 52 extends horizontally and outwardly from a top end of the protecting cage 50. A plurality of apertures (not labeled) are defined along a circumference of the pressing flange 52. The apertures are aligned with the securing holes 620 of the pressing frame 60, respectively. Fasteners (not shown) are extended through the apertures and the securing holes 620 to secure the pressing frame 60 with the protecting cage 50.

In assembly, the LED module 20 is mounted on the bottom face of the supporting plate 12; the light-reflecting member 30 is fixed to a bottom face of the printed circuit board 22 with the LEDs 24; the engaging flange 42 of the envelope 40 is hermetically received in the receiving groove 120 of the heat sink 10 to receive the LED module 20 and the light-reflecting member 30 therein; the pressing frame 60 is disposed on the envelope 40 and fixed to the heat sink 10 to press the envelope 40 against the heat sink 10, wherein the protruding tabs 64 of the pressing frame 60 horizontally protrude outside of the engaging flange 42 and located just above the protruding ribs 126, respectively; the protecting cage 50 surrounds an outer periphery of the envelope 40 with the pressing flange 52 thereof securely fixed to the pressing frame 60.

Figure 4:
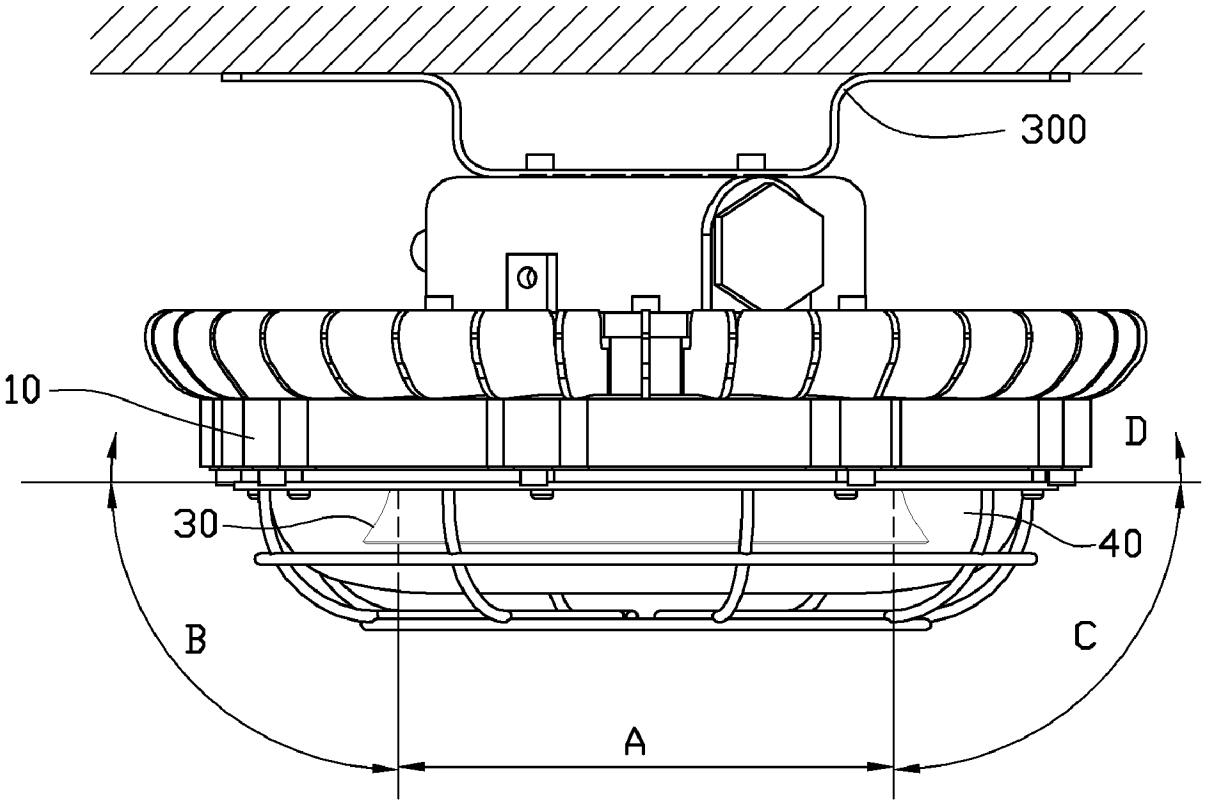
FIG. 4 is a front view of FIG. 1, showing an angular distribution of light generated by the LED lamp.

The above-described LED lamp can be applied in various occasions to meet large-area illumination requirements thereof. For example, the LED lamp could be secured to a ceiling via the fixing bracket 300, as shown in FIG. 4. Referring to FIG. 4, the LED lamp has three illumination regions including a main working region A just below the LED lamp, a periphery working area B/C surrounding the region A and beneath a plane of the printed circuit board 22, and a subordinate working area D above the plane of the printed circuit board 22. In operation, the light generated by the first LEDs 242 directly illuminates the main working area A. The light directly emitted by the second LEDs 244 and the light of the second LEDs 244 reflected by the reflecting portion 34 illuminates the periphery working area B and C. A part of light reflected by the reflecting portion 34 from the second LEDs 244 escapes to the subordinate working area D. Thus, the light emitted by the LED lamp has an emergent angle over 180 degrees.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp comprising:

a heat sink comprising a supporting plate;

a light-reflecting member mounted on a bottom face of the supporting plate, and the light-reflecting member defining a plurality of concave portions recessed inwardly from an outer face thereof; and a plurality of LEDs disposed on the bottom face of the supporting plate, and the LEDs comprising a plurality of first LEDs arranged within the light-reflecting member and a plurality of second LEDs arranged outside the light-reflecting member;

wherein the second LEDs are located corresponding to the concave portions, respectively, whereby light reflected by the light-reflecting member can illuminate an area away from a space facing the first LEDs of the LED lamp.

2. The LED lamp as described in claim 1, wherein a diameter of the light-reflecting member increases gradually along a direction away from the bottom face of the supporting plate.

3. The LED lamp as described in claim 1, wherein the concave portions are spaced from each other and distributed evenly along an outer circumference of the light-reflecting member.

4. The LED lamp as described in claim 1, wherein the first LEDs and the second LEDs are arranged in a plurality of concentric imaginary circles.

5. The LED lamp as described in claim 1, wherein the light reflected by the light-reflecting member have an emergent angle over 180 degrees.

6. The LED lamp as described in claim 1, wherein the light-reflecting member comprises a planar and annular seat horizontally attached to the bottom face of the supporting plate, and a cylindrical reflecting portion extending downwardly from the seat.

7. The LED lamp as described in claim 6, wherein the reflecting portion has a waved configuration.

8. The LED lamp as described in claim 1, wherein each concave portion of the light-reflecting member partially surrounding one of the second LEDs, whereby the light generated by the one of the second LEDs can be reflected by the concave portion.

9. The LED lamp as described in claim 1, wherein each of the concave portions has a convex inner reflecting surface facing a corresponding one of the first LEDs and a concave outer reflecting surface facing a corresponding one of the second LEDs.

10. The LED lamp as described in claim 9, wherein each of the inner and outer reflecting surfaces of each concave portion is one of a paraboloid surface, a spherical surface, an aspheric surface and an ellipsoid surface.

11. The LED lamp as described in claim 9, wherein the inner and outer reflecting surfaces of each concave portion each is one of a diffused, reflective surface and a highly reflective surface.

12. The LED lamp as described in claim 1, wherein an annular receiving groove is recessed from a periphery of the bottom face of the supporting plate.

13. The LED lamp as described in claim 12 further comprising an envelope which comprises a bowl-shaped main body defining an opening facing the heat sink and an engaging flange extending outwardly from a periphery of the main body, and the engaging flange is fitly received in the receiving groove for connecting the envelope and the heat sink together.

14. The LED lamp as described in claim 13 further comprising a pressing frame in an annular shape disposed on the engaging flange of the envelope for securing the envelope to the heat sink.

15. The LED lamp as described in claim 13, further comprising a protecting cage covering an outer face of the envelope, the protecting cage comprising a plurality of wires interlaced with each other.

* * * * *